US008112010B2

(12) United States Patent
Yoshimoto

(10) Patent No.: US 8,112,010 B2
(45) Date of Patent: Feb. 7, 2012

(54) ENERGIZATION CONTROL DEVICE AND IMAGE FORMING APPARATUS

(75) Inventor: Totsuhiro Yoshimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 292 days.

(21) Appl. No.: 12/399,842

(22) Filed: Mar. 6, 2009

(65) Prior Publication Data

US 2010/0172668 A1 Jul. 8, 2010

(30) Foreign Application Priority Data

Mar. 7, 2008 (JP) ..... 2008-057311
Feb. 26, 2009 (JP) ..... 2009-044198

(51) Int. Cl.
*G03G 15/20* (2006.01)
*H05B 1/00* (2006.01)

(52) U.S. Cl. ..... 399/69; 219/494

(58) Field of Classification Search ..... 399/69, 399/88, 37; 219/494
See application file for complete search history.

(56) References Cited

U.S. PATENT DOCUMENTS

| | | | | |
|---|---|---|---|---|
| 5,149,941 | A | 9/1992 | Hirabayashi et al. | |
| 6,173,131 | B1 * | 1/2001 | Kitamura et al. | 399/69 |
| 6,496,665 | B2 * | 12/2002 | Umezawa et al. | 399/69 |
| 2005/0169658 | A1 * | 8/2005 | Hanamoto et al. | 399/88 |
| 2006/0051118 | A1 | 3/2006 | Kaji et al. | |

FOREIGN PATENT DOCUMENTS

JP 2002-050450 A 2/2002

* cited by examiner

*Primary Examiner* — Susan Lee
(74) *Attorney, Agent, or Firm* — Canon USA Inc IP Division

(57) ABSTRACT

A heating unit heated upon receiving power supplied from an AC power supply, a temperature detecting unit detecting the temperature of the heating unit, a memory storing power energization pattern in which power energization and non-power energization are performed for each percentage of AC power, and a power control unit that determines the percentage of AC power applied to the heating unit based on the temperature and that determines the power energization pattern by referring to the memory are provided. When the power energization percentage is changed, the power control unit changes the power energization pattern after the power energization percentage is changed in accordance with the changed power energization percentage based on the power energization pattern before the power energization percentage is changed and the power energization pattern after the power energization percentage is changed.

7 Claims, 12 Drawing Sheets

FIG. 5

| OUTPUT | HEATING ELEMENT | FIRST | SECOND | THIRD | FOURTH | FIFTH | SIXTH | SEVENTH | EIGHTH |
|---|---|---|---|---|---|---|---|---|---|
| 0.0% | UPSTREAM | 0 | 0 | 0 | 0 | 0 | 0 | 0 | 0 |
| | DOWNSTREAM | 0 | 0 | 0 | 0 | 0 | 0 | 0 | 0 |
| 12.5% | UPSTREAM | 1 | 1 | 0 | 0 | 0 | 0 | 0 | 0 |
| | DOWNSTREAM | 0 | 0 | 0 | 0 | 0 | 0 | 0 | 0 |
| 25.0% | UPSTREAM | 0 | 0 | 0 | 0 | 1 | 1 | 0 | 0 |
| | DOWNSTREAM | 0 | 0 | 1 | 1 | 0 | 0 | 0 | 0 |
| 37.5% | UPSTREAM | 0 | 0 | 1 | 1 | 0 | 0 | 0 | 0 |
| | DOWNSTREAM | 1 | 1 | 0 | 0 | 1 | 1 | 0 | 0 |
| 50.0% | UPSTREAM | 0 | 0 | 1 | 1 | 1 | 1 | 0 | 0 |
| | DOWNSTREAM | 1 | 1 | 0 | 0 | 0 | 0 | 1 | 1 |
| 62.5% | UPSTREAM | 1 | 1 | 1 | 1 | 1 | 1 | 0 | 0 |
| | DOWNSTREAM | 0 | 0 | 1 | 1 | 0 | 0 | 1 | 1 |
| 75.0% | UPSTREAM | 1 | 1 | 1 | 1 | 1 | 1 | 1 | 1 |
| | DOWNSTREAM | 1 | 1 | 0 | 0 | 1 | 1 | 0 | 0 |
| 87.5% | UPSTREAM | 0 | 0 | 1 | 1 | 1 | 1 | 1 | 1 |
| | DOWNSTREAM | 1 | 1 | 1 | 1 | 1 | 1 | 1 | 1 |
| 100.0% | UPSTREAM | 1 | 1 | 1 | 1 | 1 | 1 | 1 | 1 |
| | DOWNSTREAM | 1 | 1 | 1 | 1 | 1 | 1 | 1 | 1 |

FIG. 10

| OUTPUT | HEATING ELEMENT | FIRST | SECOND | THIRD | FOURTH | FIFTH | SIXTH | SEVENTH | EIGHTH |
|---|---|---|---|---|---|---|---|---|---|
| 0.0% | UPSTREAM | 0 | 0 | 0 | 0 | 0 | 0 | 0 | 0 |
| | DOWNSTREAM | 0 | 0 | 0 | 0 | 0 | 0 | 0 | 0 |
| 12.5% | UPSTREAM | 0 | 0 | 1 | 1 | 0 | 0 | 0 | 0 |
| | DOWNSTREAM | 0 | 0 | 0 | 0 | 0 | 0 | 0 | 0 |
| 25.0% | UPSTREAM | 0 | 0 | 0 | 0 | 0 | 0 | 1 | 1 |
| | DOWNSTREAM | 1 | 1 | 0 | 0 | 0 | 0 | 0 | 0 |
| 37.5% | UPSTREAM | 1 | 1 | 0 | 0 | 0 | 0 | 0 | 0 |
| | DOWNSTREAM | 0 | 0 | 1 | 1 | 0 | 0 | 0 | 0 |
| 50.0% | UPSTREAM | 1 | 1 | 0 | 0 | 0 | 0 | 1 | 1 |
| | DOWNSTREAM | 0 | 0 | 1 | 1 | 1 | 1 | 0 | 0 |
| 62.5% | UPSTREAM | 1 | 1 | 1 | 1 | 0 | 0 | 1 | 1 |
| | DOWNSTREAM | 1 | 1 | 0 | 0 | 1 | 1 | 0 | 0 |
| 75.0% | UPSTREAM | 1 | 1 | 1 | 1 | 1 | 1 | 1 | 1 |
| | DOWNSTREAM | 0 | 0 | 1 | 1 | 0 | 0 | 1 | 1 |
| 87.5% | UPSTREAM | 1 | 1 | 0 | 0 | 1 | 1 | 1 | 1 |
| | DOWNSTREAM | 1 | 1 | 1 | 1 | 1 | 1 | 1 | 1 |
| 100.0% | UPSTREAM | 1 | 1 | 1 | 1 | 1 | 1 | 1 | 1 |
| | DOWNSTREAM | 1 | 1 | 1 | 1 | 1 | 1 | 1 | 1 |

ENERGIZATION CONTROL DEVICE AND IMAGE FORMING APPARATUS

BACKGROUND OF THE INVENTION

1. Field of the Invention

The present invention relates to an energization control device configured to control power applied to a heater, and particularly relates to an image forming apparatus configured to control power applied to a fusing unit used during electrophotography process.

2. Description of the Related Art

A heat roller system has been widely used for an electrophotography copier, as a method of fusing an image on a recording material including a sheet of paper or the like. FIG. 2 is a sectional view of a fusing device using the heat roller system. A toner image formed on a photoconductor is transferred onto one of the faces of a recording sheet P. The above-described toner image is fused onto the recording sheet P by being heated and pressed when the recording sheet P is transmitted between a fuser roll 202 and a pressure roll 203 along the direction of an arrow A.

The fuser roll 202 includes a cylindrical roll 202*a* and a halogen heater 202*b* provided in the cylindrical roll 202*a* as a heat source. In general, the heat roller system allows for performing fusing operations with stability by increasing the heat capacity of a fuser roller and storing heat in the fuser roller. However, due to the increased heat capacity, it takes a long time until the temperature of the fuser roller reaches a desired temperature. Further, the heat roller system consumes power while waiting for image forming operations, so as to keep the fuser roller at a constant temperature.

According to the invention disclosed in U.S. Pat. No. 5,149,941, a film-heating type heating device is used as a system to reduce the above-described waiting time. A film-heating type fusing device uses a plane heater including a ceramic heater or the like (hereinafter referred to as the plane heater) as the heat source.

The fusing device using the above-described ceramic heater performs a fusing operation by directly pressing a film sliding on the heater against a recording sheet. Therefore, the temperature of the heater significantly affects the fusing temperature of the recording sheet. Accordingly, the heater temperature should be stabilized in units of short time, so as to reduce the temperature ripple of the heater. In general, the method of controlling the percentage of power applied to the heater per unit time has been used as a method of controlling the short-time unit.

As a method of controlling the power energization percentage, the following method has been used. Namely, a single half wave of an alternating current voltage (50 Hz) generated by a commercial power supply is determined to be the unit time, and the percentage of power applied during the time period corresponding to twenty half waves (200 ms) or the like is adjusted. The above-described adjusting method is attained by using a power energization pattern table. According to the above-described power energization pattern table, the state in which the power corresponding to all of the twenty half waves is applied to the heater is determined to be 100%. Further, the power energization percentage is changed in steps of 10%. A desired power energization amount is calculated by comparing the detection result of the heater temperature with a target fusing temperature every 200 ms, so as to keep the fusing temperature constant, and a power energization pattern used for the next 200 ms is determined.

However, since the amount of power applied to the heater is changed with relatively high speed, the occurrence of flicker often becomes significant. The flicker denotes the state in which lighting connected to the same line used for the power supply flickers due to fluctuations in a power supply voltage, the fluctuations being caused by power consumption of an electric appliance.

United States Patent Application No. 20060051118 discloses the following invention as a method of reducing the flicker of the film heating system using the above-described resistor heater. Namely, the amounts of power applied to two resistor heaters per unit time are equalized. Further, by making the resistance values of the two resistor heaters different from each other, the difference between the drops of the power supply voltages is reduced, where the drops vary based on the type of the power energization pattern. Further, the invention disclosed in Japanese Patent Laid-Open No. 2002-50450 has proposed the method of assigning a heater control pattern to each of the temperature ranges of the heater and switching over to another heater control pattern in sequence, so as to reduce the fluctuations in the power supply voltage.

In the European Community (EC) market, the amount of the flicker occurrence has been restricted by International Electrotechnical Commission (IEC) standards. According to IEC 61000-3-3 standard, a flicker should be measured through a flicker meter. Further, the flicker value should be expressed as a Pst value, and the expression $Pst \leqq 1.00$ should hold. Further, the Pst value is calculated based on the power supply voltage-fluctuation amount and the responsivity of the flicker meter attained centering on the frequency of 8.8 Hz. The above-described responsivity corresponds to the standard of the threshold value of flicker perceived by a person. That is to say, as the frequency value nears 8.8 Hz, the easier it becomes for a person to perceive the flicker.

The heating device used for the image forming apparatus consumes a relatively large amount of power, such as 1000 W or around. Further, the power energization amount is changed at regular intervals, so as to control the temperature of a fuser heater, so that the flicker occurs easily.

Usually, power is supplied from a commercial power supply, which is an AC power supply, to the heating device. At that time, the power energization percentage on the positive side should be equal to that on the negative size (symmetry in the positive and negative directions) in the unit time (corresponding to every wave of the AC power supply), so as not to affect the power supply. Further, the power energization pattern is selected for every predetermined unit time, so as to keep the fusing temperature in a predetermined temperature range. Further, according to the power energization pattern, a single positive half wave and a single negative half wave are grouped, so as to switch between the power energization state and the non-power energization state of the heater. Consequently, the symmetry in the positive and negative directions is maintained.

According to the above-described configuration, the frequencies of power applied to the heaters are distributed from a low order to a high order centering on a frequency of 50 Hz, which is the frequency of the commercial power supply. Further, since the heater-power-energization pattern is changed at the time determined based on a plurality of half waves of the commercial power supply, the change is made at a frequency lower than the frequency of 50 Hz. According to United States Patent Application No. 20060051118 and/or Japanese Patent Laid-Open No. 2002-50450, no consideration is given to the flicker sensitivity which is increased due to the above-described change in the power energization pattern, the change being made at the low frequency.

SUMMARY OF THE INVENTION

The present invention provides a power energization control device which can solve the above-described problems.

The present invention also provides a device configured to control power applied to a heater, where the power energization control device can keep the temperature ripple of a fusing device constant and reduce flicker caused by a change in the amount of power applied to the fusing device.

The present invention further provides a power energization control device which can change a power energization pattern so that a frequency used to make the power energization change becomes higher than the frequency corresponding to a high flicker sensitivity.

According to a first aspect of the present invention, there is provided a power energization control device including a heating unit heated upon receiving power supplied from an alternating-current power supply, a temperature detecting unit configured to detect a temperature of the heating unit, a memory storing data of a power energization pattern indicating an order in which power energization and non-power energization are performed for each percentage of alternating current power supplied to the heating unit, and a power control unit configured to determine a percentage of alternating current power applied from the alternating-current power supply to the heating unit based on the detected temperature and determine a pattern of applying power to the heating unit by referring to the memory, wherein, when the power energization percentage is changed, the power control unit changes the power energization pattern in accordance with the changed power energization percentage based on a power energization pattern corresponding to at least one predetermined cycle occurring before the power energization percentage is changed and a power energization pattern corresponding to at least one predetermined cycle occurring after the power energization percentage is changed.

Further features of the present invention will become apparent from the following description of exemplary embodiments and Claims with reference to the attached drawings.

BRIEF DESCRIPTION OF THE DRAWINGS

FIG. 5 is a table showing power applied to heaters.

FIG. 10 is another table showing power applied to the heaters.

DESCRIPTION OF THE EMBODIMENTS

Hereinafter, embodiments of the present invention will be described with reference to the attached drawings.

Figure 1:
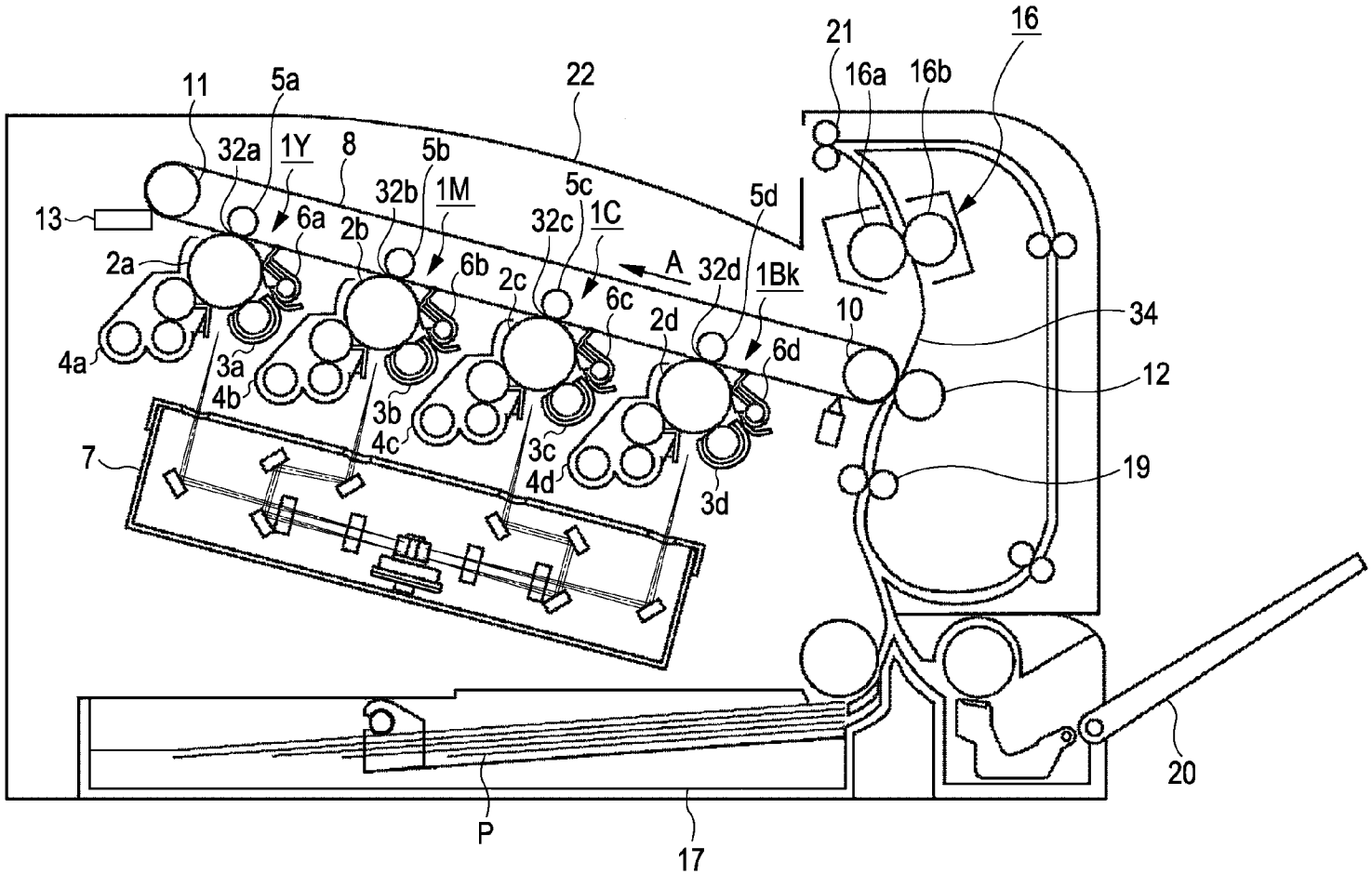
FIG. 1 is a sectional view showing the configuration of an image forming apparatus.
Figure 2:
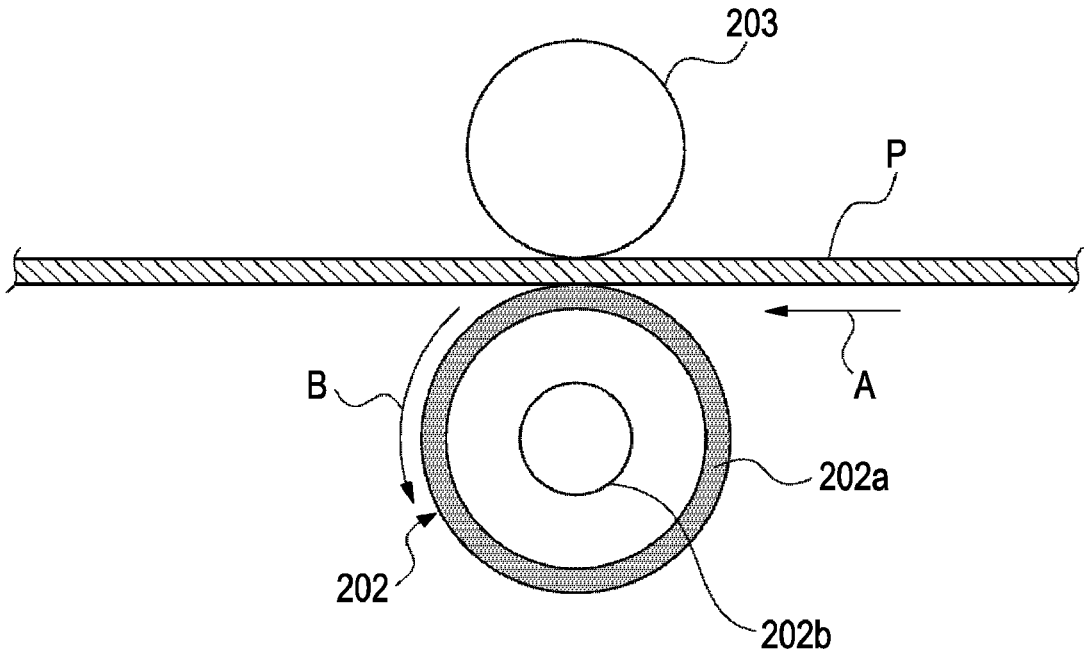
FIG. 2 shows an exemplary fusing device.

FIG. 1 is a schematic configuration diagram showing an electrographic color image forming apparatus according to an embodiment of the present invention. The above-described image forming apparatus includes four image forming units including an image forming unit 1Y configured to form an image having a yellow color, an image forming unit 1M configured to form an image having a magenta color, an image forming unit 1C configured to form an image having a cyan color, and an image forming unit 1Bk configured to form an image having a black color. The above-described four image forming units 1Y, 1M, 1C, and 1Bk are arranged in a line at regular intervals. The image forming apparatus includes paperfeed units 17 and 20 provided below the image forming units, where each of the paperfeed units 17 and 20 is configured to feed a recording sheet. The image forming apparatus further includes a fusing unit 16 provided above the image forming units.

Each of the above-described units will be described in detail. Drum-shaped electrophotographic photoconductors (hereinafter referred to as photoconductive drums) 2*a*, 2*b*, 2*c*, and 2*d*, which are provided as image bearing members, are installed in the individual image forming units 1Y, 1M, 1C, and 1Bk. Primary chargers 3*a*, 3*b*, 3*c*, and 3*d*, developing devices 4*a*, 4*b*, 4*c*, and 4*d*, transfer rollers 5*a*, 5*b*, 5*c*, and 5*d* that are provided as transfer units, and drum cleaner devices 6*a*, 6*b*, 6*c*, and 6*d* are provided around the individual photoconductive drums 2*a*, 2*b*, 2*c*, and 2*d*.

A laser exposure device 7 is installed at a place which is below and sandwiched between the primary chargers 3*a*, 3*b*, 3*c*, and 3*d*, and the developing devices 4*a*, 4*b*, 4*c*, and 4*d*. Each of the photoconductive drums 2*a*, 2*b*, 2*c*, and 2*d* includes an aluminum cylindrical base which is a negatively charged organic photoconductor (OPC), where a photoconductive layer is provided on the aluminum cylindrical base. Further, each of the photoconductive drums 2*a*, 2*b*, 2*c*, and 2*d* is rotated and driven at a predetermined process speed in the direction of the arrow (clockwise direction) through a driving device (not shown).

The primary chargers 3*a*, 3*b*, 3*c*, and 3*d*, which are provided as primary charger sections, uniformly charge the surfaces of the individual photoconductive drums 2*a*, 2*b*, 2*c*, and 2*d* through charging biases applied from a charging-bias source (not shown) at a predetermined negative potential. The laser exposure device 7 includes a laser light-emitting element configured to emit the light corresponding to time-series electric digital pixel signals of transmitted image information, a polygon lens, a reflecting mirror, and so forth, and performs exposures for the photoconductive drums 2*a* to 2*d*, whereby electrostatic latent images having the colors corresponding to the image information are formed on the surfaces of the individual photoconductive drums 2*a* to 2*d* that are charged through the individual primary chargers 3*a* to 3*d*.

A yellow toner, a cyan toner, a magenta toner, and a black toner are accommodated in the individual developing devices 4*a* to 4*d* so that the above-described color toners are adhered to the electrostatic latent images formed on the individual photoconductive drums 2*a* to 2*d* and the electrostatic latent images are developed (visualized) into toner images.

The transfer rollers 5*a* to 5*d*, which are provided as the primary transfer sections, are arranged in the individual primary transfer units 32*a*, 32*b*, 32*c*, and 32*d*, so as to be brought into contact with the individual photoconductive drums 2*a* to 2*d* via an intermediate transfer belt 8. Consequently, the toner images formed on the photoconductive drums 2*a* to 2*d* are sequentially transferred on the intermediate transfer belt 8 so that the toner images are superimposed on one another.

Each of the drum cleaner devices 6*a* to 6*d* includes a cleaning blade or the like so that the toners remaining after the primary transfer are scraped off the photoconductive drums 2*a* to 2*d*. Consequently, the surfaces of the photoconductive drums 2*a* to 2*d* are cleaned.

The intermediate transfer belt 8 is provided above the top faces of the individual photoconductive drums 2*a* to 2*d* and stretched between the secondary transfer counter roller 10 and a tension roller 11. The secondary transfer counter roller 10 is provided in a secondary transfer unit 34, so as to be brought into contact with the secondary transfer roller 12 via the intermediate transfer belt 8.

Further, the intermediate transfer belt 8 includes a dielectric resin including polycarbonate, a polyethylene terephthalate resin film, a polyvinylidene fluoride resin film, and so forth.

In the secondary transfer unit 34, the images transferred to the intermediate transfer belt 8 are conveyed from the paperfeed unit 17 and transferred to a recording sheet. A belt cleaning device 13 configured to remove and recover the toners remaining on the surface of the intermediate transfer belt 8 after the transfer is provided outside the intermediate transfer belt 8 and in the proximity of the tension roller 11. Performing the above-described processing procedures allows for forming an image by using the toners.

The paperfeed unit 17 includes a cassette in which recording sheets P are accommodated and the paperfeed unit 20 includes a manual feed tray. Further, pickup rollers (not shown) configured to transmit the recording sheets P from the cassette and/or the manual feed tray one after another and a paperfeed roller configured to convey the recording sheet P transmitted from each of the pickup rollers to a registration roller 19 are provided. The registration roller 19 stops the fed recording sheet, and transmits the fed recording sheet to the secondary transfer roller 12 at the same time as when the image forming unit forms an image.

A fusing unit 16 includes a fusing film 16*a* including a heat source such as an alumina heater and a pressure roller 16*b* (the pressure roller 16*b* may include the heat source), where a film is sandwiched between a substrate and the pressure roller 16*b* and the pressure roller 16*b* is pressurized. The above-described fusing unit functions as a heating section which is heated upon receiving power supplied from an alternating-current power supply. Further, an external discharge roller 21 configured to lead the recording sheet P discharged from the fusing unit 16 to a tray 22 of the apparatus is provided downstream of the fusing unit 16.

Next, the configuration of a film heating type fusing device (hereinafter referred to as the fusing device) used in the above-described embodiment will be described.

Figure 3:
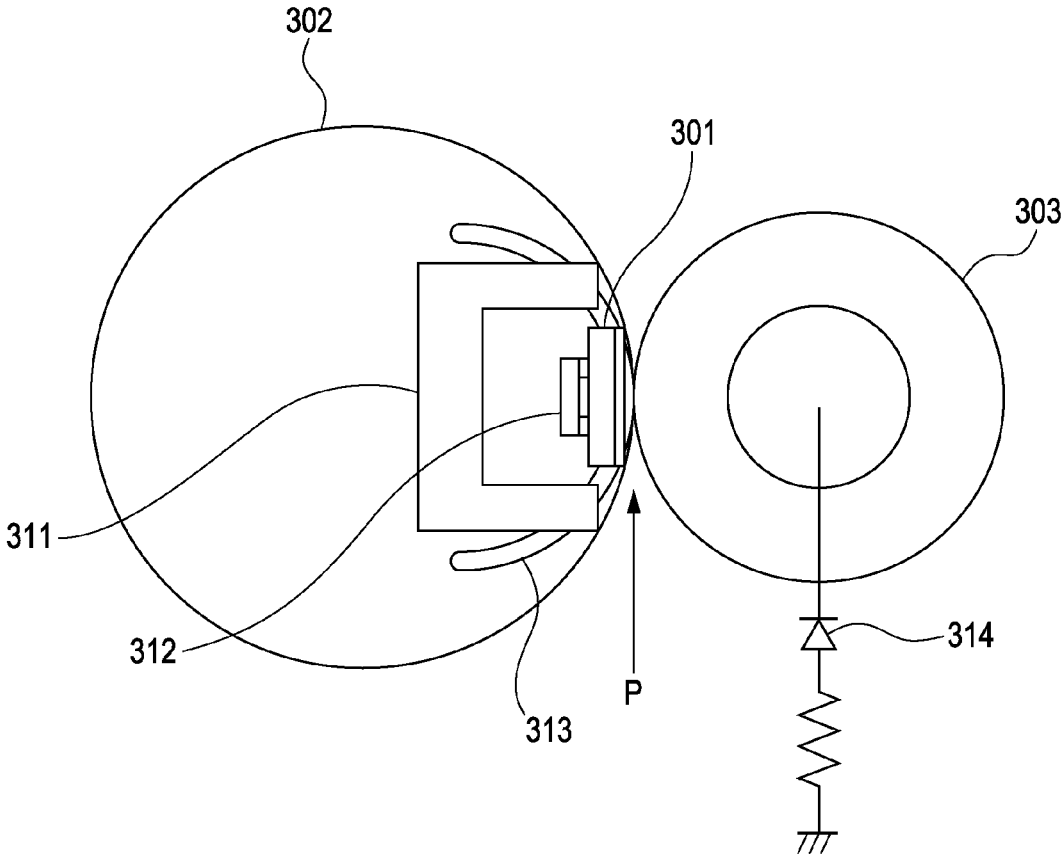
FIG. 3 shows another exemplary fusing device.

FIG. 3 is a configuration diagram showing the details of a fusing device 16. A ceramic heater 301, a fusing film 302, a pressure roller 303, a metal sheet 311, a thermistor 312 configured to detect the temperature of the heater, a holder 313 to which the thermistor 312 and/or the heater 301 is fixed, and a self bias circuit 314 are provided. The heater 301 is a highly responsive heater (see FIG. 8) including ceramic on which a heating pattern is printed, where the temperature of the heater 301 is increased by as much as 50° C. per second.

The fusing film 302 includes metal, as its base material, and a rubber layer having a thickness of about 300 μm on the base material, where the rubber layer is subjected to fluoride surface treatment. The fusing film 302 has a heat capacity so small that only the nip thereof conducts the heat of the heater 301. The pressure roller 303 has a hardness of about 60° and frictionally drives the fusing film 302. The metal sheet 311 presses the fusing film 302 against the pressure roller 303 from the inside, and the force of the pressure is 180 N or around.

The thermistor 312 includes a main thermistor provided in the center of the heater and a sub thermistor provided at the end of the heater. The sub thermistor detects an increase in the temperature of the non-paper feeding unit of the fusing device 16, where the increase occurs upon being fed with a sheet having a small size such as a size of 182×257 mm (B5 size).

The toner image shown on the recording sheet P is fused on the recording sheet P by being heated and pressurized (pressured by a flat heater and the pressure roller) when the recording sheet P is transmitted between the film 302 and the pressure roller 303 along the direction of the arrow. Although the heater 301 is fixed, it is configured that the film 302 is rotated as the pressure roller is rotated. When the toner image is fused on the recording sheet P through the above-described configuration, the heat of the heater 301 is immediately conducted to the recording sheet P via the film 302. Therefore, the time elapsed from when the energization of heat to the flat heater is started to when printing is permitted is short.

Next, a circuit configured to control the energization of power to the heater 301 provided in the fusing device 16 will be described.

Figure 4A:
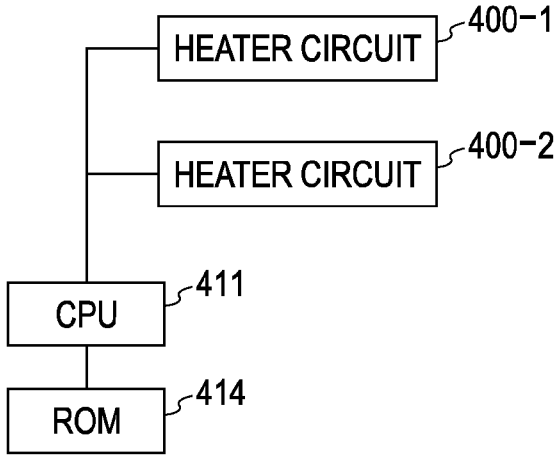
FIG. 4A is a configuration diagram showing a heater control unit.
Figure 4B:
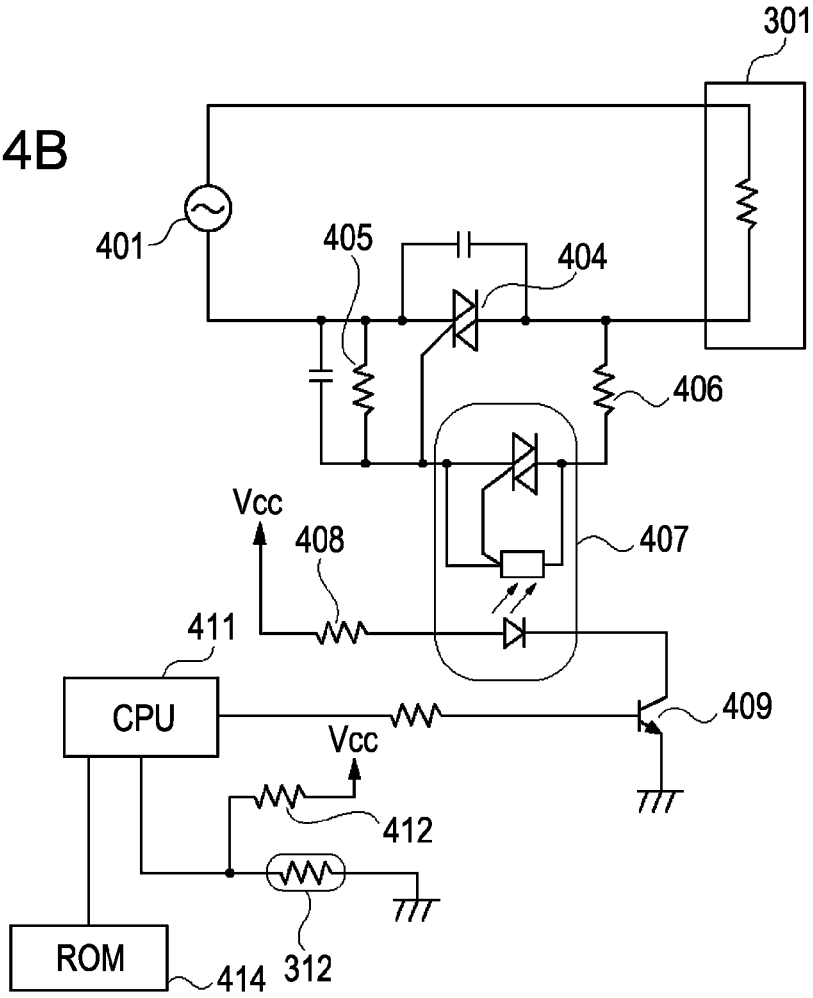
FIG. 4B is another configuration diagram showing the heater control unit.

Each of FIGS. 4A and 4B is a circuit diagram showing the configuration of a control circuit provided to perform drive control and/or fault detection for the heater 301. In FIG. 4A, a central processing unit (CPU) 411 is provided to control operations of the control circuit. The configurations of heater circuits 400-1 and 4002 are the same. The heater 301 includes two heaters, where one of the heaters is provided upstream of the direction in which the recording sheet P is conveyed and the other is provided downstream of the direction in which the recording sheet P is conveyed. The drive circuits of the two heaters correspond to the individual heater circuits 400-1 and 400-2.

FIG. 4B is a circuit diagram showing the details of only one of the heater circuits 400-1 and 400-2, as the representative of the heater circuits 400-1 and 400-2. An alternating current (AC) power supply 401 is provided as a commercial power supply configured to supply power to the entire printer, for example. The heater 301 produces heat upon receiving power transmitted from the AC power supply 401.

A triac 404 is configured to turn on and/or off the energization of power to the heater 301, where the power is applied from the AC power supply 401. Bias resistors 405 and 406 are provided for the triac 404. A photo-triac coupler 407 is connected in series between the bias resistors 405 and 406. When power is passed through the light-emitting diode (LED) of the photo-triac coupler 407, the triac 404 is turned on.

Further, the photo-triac coupler 407 functions as a device configured to ensure the creepage distance between the primary side and the secondary side of the power supply. A resistor 408 is provided to control the current of the photo-triac coupler 407. A resistor 410 and a transistor 409 configured to control the energization of power to the LED of the photo-triac coupler 407 are provided. The transistor 409 is turned on upon receiving an ON signal transmitted from the CPU 411, and makes the LED emit light.

The temperature of the heater 301 is detected by the thermistor 312. The thermistor 312 has a negative temperature coefficient (NTC) property so that the resistor value decreases with increasing temperature. A power supply voltage Vcc is divided by the resistor 412 and the thermistor 312, and the CPU 411 detects the temperature of the heater 301 by detecting the divided voltages. The above-described thermistor 312 functions as a detecting section configured to detect the temperature of the heater 301, which is part of the heating section.

Next, a method of controlling the fusing device 16 will be described with reference to FIG. 5.

FIG. 5 shows a power energization table used when a heating device (fusing device) including two heaters is provided. Data of the power energization table is stored in a read only memory (ROM) 414. The power energization table shows the definition of the pattern of applying power and/or no power to each of heating elements, that is, the power energization pattern indicating the order in which the power energization and the non-power energization are performed, where the power energization pattern is defined to control the percentage of power applied to each of the heaters in units of eight half waves. The power energization and/or the non-power energization is performed for the first half wave, the second half wave, the third half wave, the fourth half wave, the fifth half wave, the sixth half wave, the seventh half wave, and the eighth half wave in that order so that the power energization control is performed.

The leftmost column shown in FIG. 5 indicates the power energization percentage (%). In the third column and afterward, 0 indicates that no power is applied to the heating element and 1 indicates that power is applied to the heating element. According to the power energization patterns, the power energization percentage is determined in steps of 12.5%. Further, the power energization pattern is determined for each of the two heaters, where the two heaters include an upstream heater and a downstream heater. It is configured that the states of the individual power energization and non-power energization corresponding to the first half wave become equivalent to those of the individual power energization and non-power energization corresponding to the second half wave so that the waveform of a negative current transmitted to each heater and that of a positive current transmitted to each heater are mirror images of each other for each wave of the AC commercial power supply.

The relationship between the first half wave and the second half wave is the same as those between the third half wave and the fourth half wave, the fifth half wave and the sixth half wave, and the seventh half wave and the eighth half wave so that the states of the individual power energization and non-power energization corresponding to each of the third half wave, the fifth half wave, and the seventh half wave are equivalent to those of the individual power energization and non-power energization corresponding to each of the fourth half wave, the sixth half wave, and the eighth half wave. That is to say, the states of the individual power energization and non-power energization corresponding to the n-th half wave (the sign n denotes a natural number) are the same as those of the individual power energization and non-power energization corresponding to the n+1-st half wave. Further, when the power is supplied to the heating element, the polarity corresponding to the n-th half wave is different from that corresponding to the n+1-st half wave.

The CPU 411 compares the temperature detected by the thermistor 312 with a target temperature, determines the power energization percentage by performing widely known proportional-integral-derivative (PID) control for temperature variations, and controls the energization of power to each heater based on the power energization pattern corresponding to the determined power energization percentage. The ROM 414 functions as a memory storing data of the power energization pattern indicating the order in which the power energization and the non-power energization are performed for each AC power energization percentage.

Figure 6:
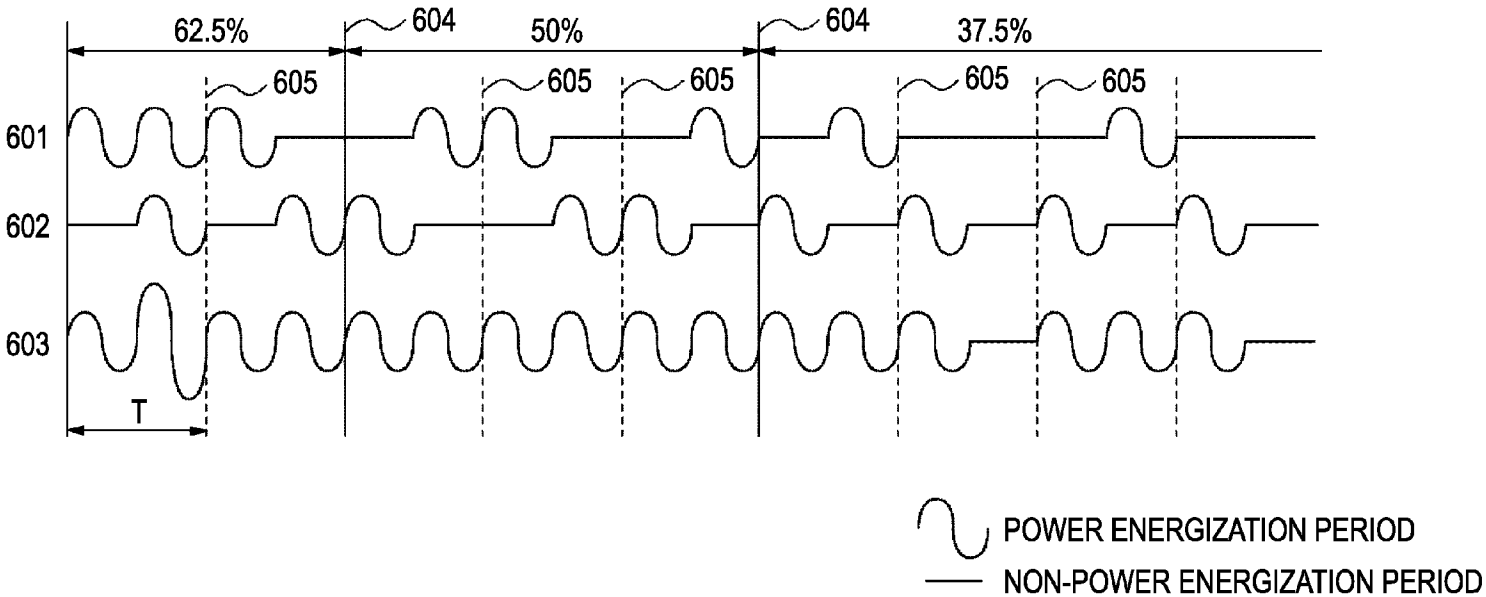
FIG. 6 is a diagram showing the waveforms of power flowing into the heaters.

FIG. 6 is a waveform diagram showing the waveforms of currents passing through the heaters. Waveforms 601 and 602 indicate the waveforms of currents passing through the heaters when the control is performed based on the power energization table shown in FIG. 5. A waveform 603 indicates the total of the amount of current used by both the heaters. Control is performed so that the waveform of a negative current transmitted to each heater and that of a positive current transmitted to each heater are mirror images of each other for each wave of the AC commercial power supply.

Although the CPU 411 changes the power energization percentage based on the temperature variations detected by the thermistor 312, whether the power energization pattern should be changed is determined at a power energization-pattern-change-determining point 605 provided for each cycle T (four half waves) shown in FIG. 6. The power energization percentage is changed at the time corresponding to each of power energization percentage-change points 604 that are shown in FIG. 6.

The CPU 411 performs control so that the temperature of the heater becomes equivalent to the target temperature by changing the power energization percentage in stages shown as 62.5%, 50%, and 37.5%, for example. Further, the CPU 411 determines whether the power energization percentage should be changed at the power energization percentage-change time determined for each cycle T determined based on the waveforms of currents transmitted from the commercial AC power supply.

If it is determined that the power energization percentage should not be changed, the CPU 411 continues applying power based on the determined power energization pattern without changing the power energization percentage. Otherwise, the CPU 411 performs control based on the power energization pattern determined based on the changed power energization percentage. At that time, two half waves are determined to be the smallest unit so that the cycle T corresponds to 2×n half waves. Consequently, the stipulation that the waveform of a negative current and that of a positive current should be mirror images of each other for each wave of the AC commercial power supply is fulfilled.

In the above-described embodiment, the cycle T corresponds to four half waves. The CPU 411 functions as a power control section configured to determine the AC power energization percentage and determine the pattern of applying power to the heater 301, which is the heating section, with reference to the ROM 411, which is a memory.

Figure 7:
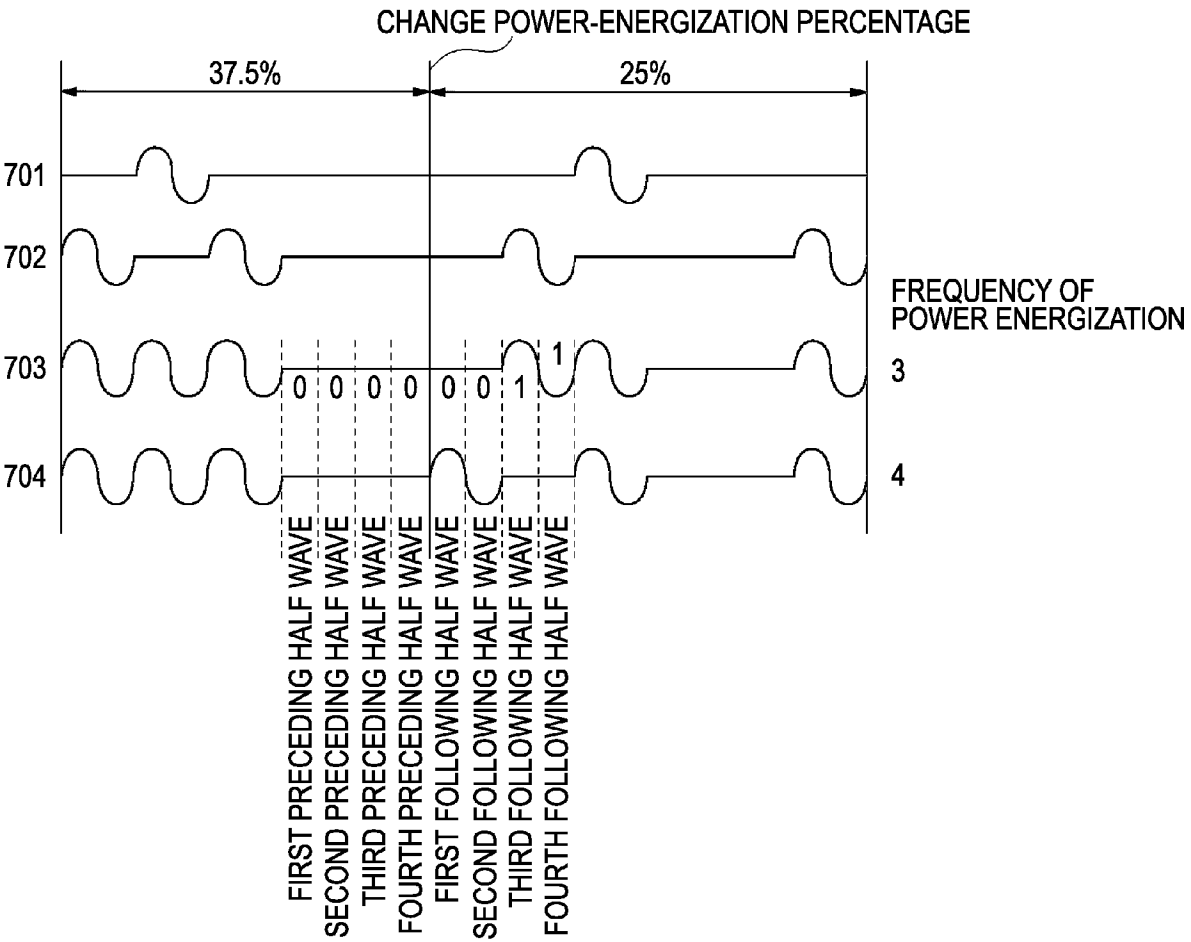
FIG. 7 is another diagram showing the waveforms of power flowing into the heaters.

Thus, the power energization percentage is changed to another power energization percentage. As a result, the non-power energization state occurs in succession before and after the power energization-percentage-change point 604. FIG. 7 exemplarily shows waveforms obtained by performing control so that the power energization percentage is changed from 37.5% to 25%. A waveform 701 indicates a current flowing through the upstream heater and a waveform 702 indicates that flowing through the downstream heater. A waveform 703 indicates the current corresponding to the total of the current flowing through the upstream heater and that flowing through the downstream heater. At the time when the power energization percentage is changed in the above-described situation, the non-power energization state occurs successively by as much as six half waves, which is shown as the waveform 703.

On the other hand, when the power energization percentage is 25% and the total of the currents of the two heaters corresponds to a power energization pattern indicated by a waveform 704, the number of times the amount of current passing through the heater is changed increases and the frequency of the change is shifted toward a higher direction. According to the waveform 703, when the power energization percentage is changed from 37.5% to 25%, control is performed so that the power energization is on by as much as six half waves (power is supplied), off by as much as six half waves (no power is supplied), and on by as much as four half waves (power is supplied). Therefore, in that configuration, the frequency of turning on/off the power energization includes a frequency component of 8.3 Hz.

On the other hand, when the power energization patterns are rearranged as indicated by the waveform 704, the frequency of turning on/off the power energization is changed to 10 Hz. Thus, the frequency of turning on/off the power energization is changed from the proximity of a frequency of about 8.3 Hz, which attains high flicker sensitivity, to a frequency of 10 Hz so that the flicker is reduced.

That is to say, the CPU 411 determines whether the power energization pattern determined based on the changed power energization percentage should be changed by comparing the power energization patterns corresponding to predetermined cycles preceding the time when the power energization percentage is changed with those corresponding to predetermined cycles following the time when the power energization percentage is changed. More specifically, when the power energization state or the non-power energization state successively occurs by as much as predetermined cycles before and after the time when the power energization percentage is changed, the CPU 411 changes the power energization pattern so that the frequency of turning on/off the power energization is increased.

A method of rearranging the power energization pattern will be described in detail. If the power energization-pattern rearrangement is performed based on the power energization table shown in FIG. 5 and when four half waves are determined to be a single group, the pattern of four half waves that will be selected next time is compared with the four half waves corresponding to the previous cycle. Consequently, whether the power energization pattern should be rearranged is determined.

Figure 8:
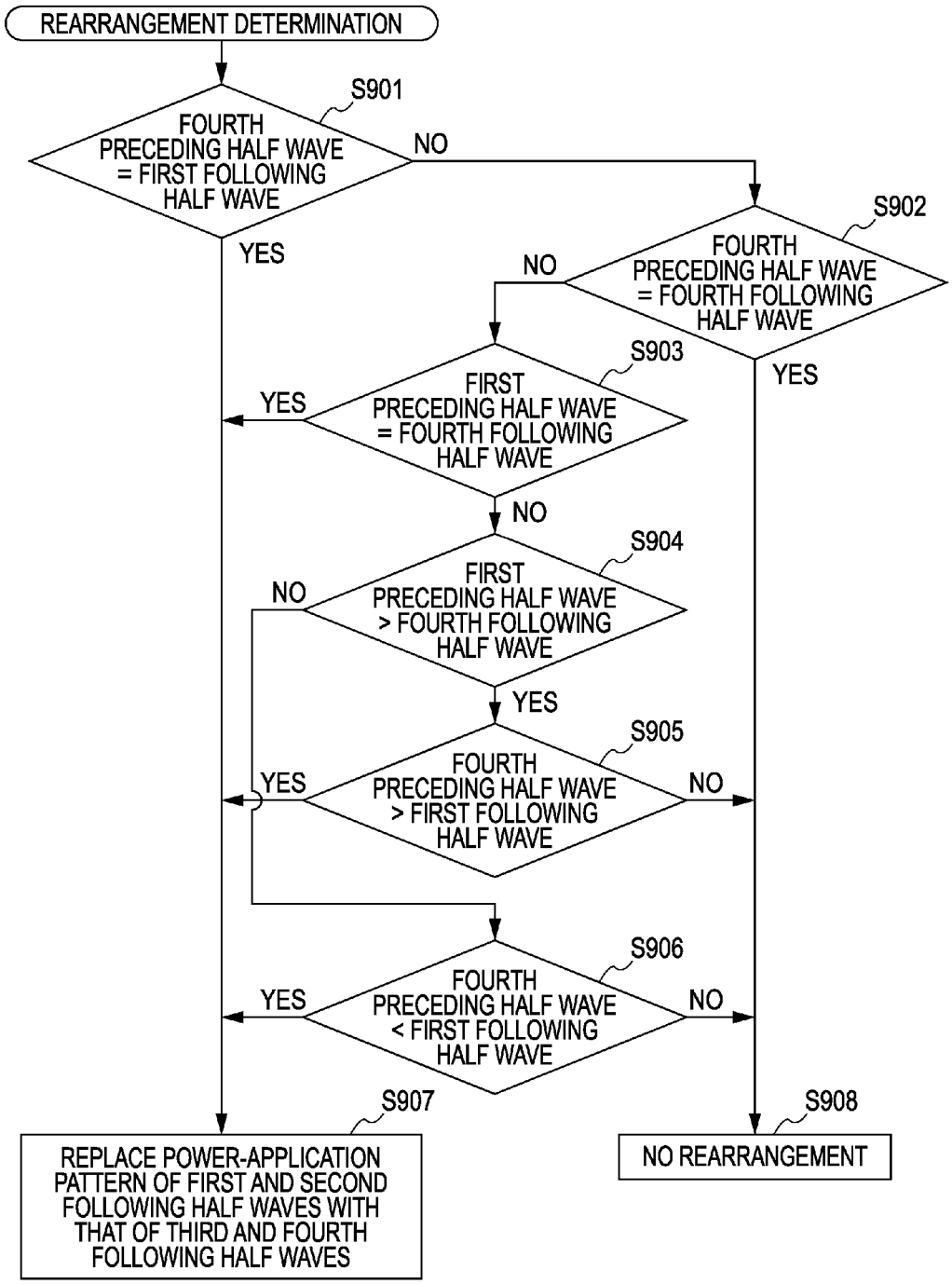
FIG. 8 is a flowchart showing processing procedures performed to determine whether the power energization pattern should be rearranged.

FIG. 8 is a flowchart showing processing procedures performed to determine whether the power energization pattern should be rearranged. The CPU 411 performs the processing procedures shown in the flowchart of FIG. 8 based on a program stored in the ROM 414.

For determining the power energization pattern of four half waves following the power energization-pattern-change point 604, the CPU 411 compares four half waves immediately preceding the change point 604 (referred to as the four preceding half waves) with four half waves following the change point 604 (referred to as the four following half waves). The first, second, third, and fourth half waves of the four preceding half waves are individually referred to as the first preceding half wave, the second preceding half wave, the third preceding half wave, and the fourth preceding half wave. Further, the first, second, third, and fourth half waves of the four following half waves are individually referred to as the first following half wave, the second following half wave, the third following half wave, and the fourth following half wave.

First, the CPU 411 compares the power energization amount corresponding to the fourth preceding half wave immediately preceding the change point 604 with that corresponding to the first following half wave following the change point 604 (step S901). As described above, the polarities corresponding to both the n-th half wave and the n+1-st half wave that are included in the power energization pattern are different from each other in the same power energization state. Therefore, comparing the power energization amount corresponding to the fourth preceding half wave with that corresponding to the first following half wave is equivalent to comparing the power energization amounts corresponding to the third and fourth preceding half waves with those corresponding to the first and second following half waves. Here, the power energization-amount comparison is made for the total of the currents passing through the upstream and downstream heaters.

When no power is supplied to both the heaters, the value of the power energization amount is determined to be 0. When power is supplied to one of the heaters, the value of the power energization amount is determined to be 1. Further, when power is supplied to both the heaters, the value of the power energization amount is determined to be 2. If the power energization amount corresponding to the fourth preceding half wave is equal to that corresponding to the first following half wave, the CPU 411 rearranges the power energization patterns.

That is to say, of the four half waves following the change point 604, the CPU 411 replaces the first and second half waves (the first and second following half waves) with the third and fourth half waves (the third and fourth following half waves) so that the power energization pattern is rearranged (S907). That is to say, the power energization control is performed for the third half wave, the fourth half wave, the first half wave, and the second half wave in that order, where the above-described half waves are included in the power energization pattern defined on the power energization pattern table.

If the power energization amount corresponding to the fourth preceding half wave is not equal to that corresponding to the first following half wave at step S901, the CPU 411 compares the power energization amount corresponding to the fourth preceding half wave with that corresponding to the fourth following half wave (step S902). If the above-described power energization amounts are equal to each other, the CPU 411 determines that the power energization pattern is not rearranged, and controls the heater 301 based on the power energization pattern in its original form (step S908).

If the power energization amount corresponding to the fourth preceding half wave is not equal to that corresponding to the fourth following half wave at step S902, the CPU 411 determines whether the power energization amount corresponding to the first preceding half wave is equal to that corresponding to the fourth following half wave (step S903). If the power energization amounts are equal to each other, the CPU 411 rearranges the power energization pattern. Otherwise, the processing advances to step S904.

At step S904, the CPU 411 determines whether the power energization amount corresponding to the first preceding half wave is larger than that of the fourth following half wave. If the power energization amount corresponding to the first preceding half wave is larger than that of the fourth following half wave, the processing advances to step S906. Otherwise, the processing advances to step S905.

At step S906, the CPU 411 determines whether the power energization amount corresponding to the fourth preceding half wave is larger than that corresponding to the first following half wave. When the power energization amount corresponding to the fourth preceding half wave is larger than that corresponding to the first following half wave, the CPU 411 rearranges the power energization pattern. On the other hand, when the power energization amount corresponding to the fourth preceding half wave is not larger than that of the first following half wave, the CPU 411 does not rearrange the power energization pattern and controls the heater 301 based on the power energization pattern in its original form.

At step S905, the CPU 411 determines whether the power energization amount corresponding to the fourth preceding half wave is smaller than that corresponding to the first following half wave. When the power energization amount corresponding to the fourth preceding half wave is smaller than that corresponding to the first following half wave, the CPU 411 rearranges the power energization pattern. On the other hand, when the power energization amount corresponding to the fourth preceding half wave is not smaller than that corresponding to the first following half wave, the CPU 411 does not rearrange the power energization pattern and controls the heater 301 based on the power energization pattern in its original form.

According to an example shown in FIG. 7, the value of the power energization amount corresponding to the fourth preceding half wave occurring before the power energization percentage is changed is zero, and that of the power energization amount corresponding to the first following half wave occurring after the power energization percentage is changed is zero. Therefore, the result of the processing corresponding to step S901 becomes "Yes" so that the power energization pattern is rearranged at step S907.

The above-described processing procedures allow for increasing the number of switching between the power energization and the non-power energization while maintaining the power energization percentage, and changing to the part of a frequency higher than the frequency component of the pattern of applying power to the heater.

The rearrangement determining processing may be performed not only when the power energization percentage is changed, but also every time the heater is driven by as much as four half waves. That is to say, four half waves occurring after the power energization percentage is changed (the first to fourth half waves) are compared with the next four half waves (the fifth to eighth half waves), and the above-described fifth to eighth half waves are compared with the first to fourth half waves of the next cycle.

A method performed by using a rearranged table will be described, as another method. FIG. 10 shows a table obtained by reversing the control order of the table shown in FIG. 5. More specifically, each of the power energization patterns shown in FIG. 5 is separated every four half waves. For every four half waves, the first and second half waves, and the third and fourth half waves are replaced with each other. Since each of the power energization patterns shown in FIG. 5 is separated every four half waves, the fifth and sixth half waves, and the seventh and eighth half waves, which are shown in FIG. 5, are also replaced with each other so that the power energization patterns are rearranged.

The CPU 411 calculates the number of times the power energization amount is changed for each of the case where the table shown in FIG. 5 is selected and the case where the table shown in FIG. 10 is selected, so as to determine whether the power energization pattern should be changed. Then, the CPU 411 selects the table showing the change number larger than the other based on the calculation result. Consequently, the CPU 411 can perform control with reduced flicker.

Figure 9:
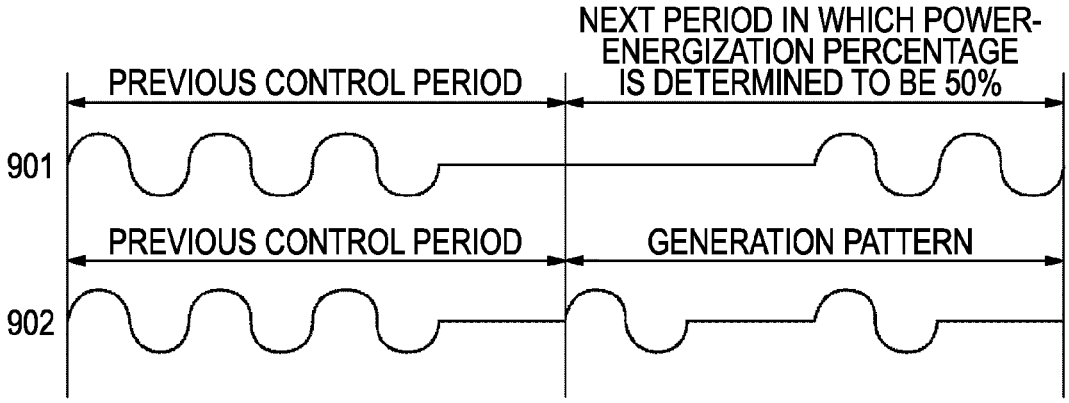
FIG. 9 is a diagram showing control patterns generated based on the power energization percentage.

FIG. 9 shows the case where the power energization table is generated based on the power energization percentages. In FIG. 9, the power energization percentage is 50%. For attaining the power energization percentage of 50%, the length of the power energization period should correspond to four half waves in the next cycle (901). The above-described power energization period is divided into two groups of two half waves, so that the power energization period corresponding to the four half waves does not occur continuously (902). Thus, even though the power energization table is not provided, it becomes possible to generate a pattern 902 based on the power energization percentage, where the pattern 902 is separated from the previous power energization pattern and the highest frequency is attained within the control cycle.

Further, whether the power energization pattern should be changed may be determined at every arbitrary cycle T.

Figure 11:
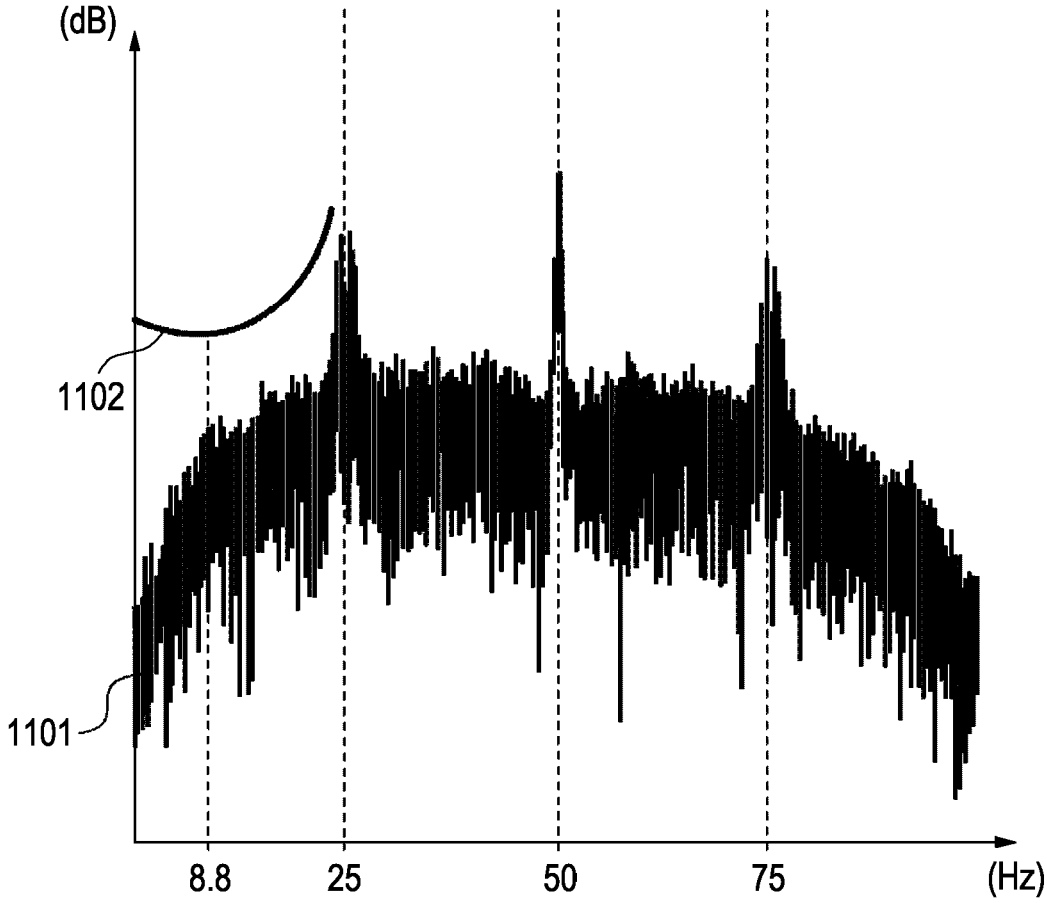
FIG. 11 is a diagram showing a frequency component used to switch between the ON state and the OFF state of the heater.

Further, a method of selecting a power energization pattern attaining the minimized flicker component by using the frequency component of the power energization pattern may be used. FIG. 11 is a diagram showing the relationship between the distribution of frequencies obtained by applying power to the heater and the flicker threshold value. When the heater is operated by switching between the power energization state and the non-power energization state through fusing operations, the frequencies of a heater-frequency component 1101 are distributed in the proximity of a frequency of 50 Hz, where the frequency of 50 Hz is the frequency of a commercial power supply.

Further, the flicker corresponding to a frequency of 8.8 Hz is the most noticeable flicker, as indicated by a flicker threshold value 1102. The above-described configuration allows for selecting the most appropriate power energization pattern by measuring a frequency component generated by the power energization pattern of the next cycle and evaluating the power energization patterns based on the flicker threshold value.

Figure 12:
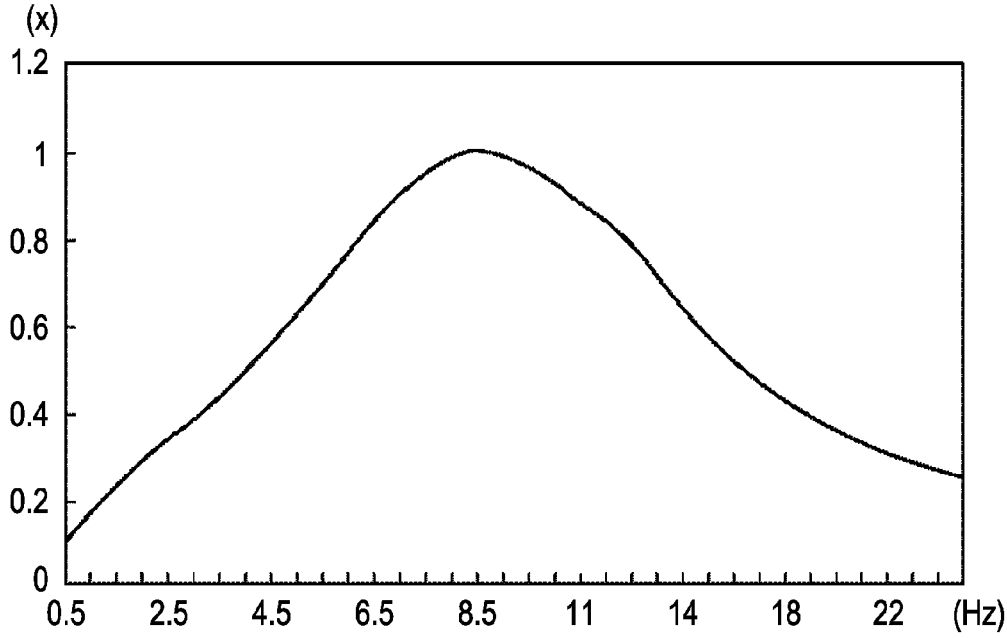
FIG. 12 is a diagram showing a weighted addition value obtained for the frequency distribution.

In FIG. 12, a weight is assigned to each of frequencies centering on a frequency of 8.8 Hz. For a measured distribution of frequencies, the frequency of 8.8 Hz shown in FIG. 12 is determined to be 1 and weights are assigned to frequencies in the 0.5- to 25-Hz range. The weighted frequencies are used for the individual frequencies, and a weighted average is obtained, so as to calculate evaluation values obtained when the power energization patterns are used. It becomes possible to obtain a power energization pattern with reduced flicker by using the power energization pattern corresponding to the lowest evaluation value. The power energization percentage and the power energization pattern can be determined according to the methods of the above-described embodiments.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-057311 filed on Mar. 7, 2008 and Japanese Patent Application No. 2009-044198 filed on Feb. 26, 2009, which are hereby incorporated by reference herein in their entirety.

What is claimed is:

1. An energization control device comprising:

a heating unit heated upon receiving power supplied from an alternating-current power supply;

a temperature detecting unit configured to detect a temperature of the heating unit;

a memory storing data of a power energization pattern in which power energization and non-power energization are performed for each power energization percentage of alternating current power supplied to the heating unit; and a power control unit configured to determine a power energization percentage of alternating current power applied from the alternating-current power supply to the heating unit based on the detected temperature and read out a power energization pattern for the heating unit from the memory according to the determined power energization percentage, wherein, when a first power energization percentage is changed to a second power energization percentage, the power control unit determines a power energization pattern at the second power energization percentage based on a power energization pattern at the first power energization percentage and a power energization pattern read out from the memory according to the second power energization percentage.

2. The energization control device according to claim 1, wherein, when a value of a frequency used to apply power and no power to the heating unit based on the power energization pattern at the first power energization percentage and the power energization pattern read from the memory according to the second power energization percentage is smaller than or equal to a predetermined value, the power control unit determines the power energization pattern at the second power energization percentage so that the value of the frequency used to apply power and no power exceeds the predetermined value.

3. The energization control device according to claim 2, wherein the power control unit determines the power energization pattern at the second power energization percentage by rearranging an order in which the power energization and the non-power energization in the power energization pattern read from the memory according to the second power energization percentage, when a value of a frequency used to apply power and no power to the heating unit based on the power energization pattern at the first power energization percentage and the power energization pattern read from the memory according to the second power energization percentage is smaller than or equal to the predetermined value.

4. The energization control device according to claim 2, wherein the power control unit determines the power energization pattern at the second power energization percentage so that power supplied in the power energization pattern at the second power energization percentage is the same as power supplied in the power energization pattern read out from the memory according to the second power energization percentage, when a value of a frequency used to apply power and no power to the heating unit based on the power energization pattern read from the memory according to the second power energization percentage is smaller than or equal to the predetermined value.

5. The energization control device according to claim 1, wherein the power control unit determines whether the power energization pattern should be changed for every cycle of two alternating current half waves ×n (n is a natural number).

6. The energization control device according to claim 2, wherein the power control unit determines the power energization pattern at the second power energization percentage by replacing first and second half waves of the power energization pattern read out from the memory according to the second power energization percentage with third and fourth half waves of-the power energization pattern read out from the memory according to the second power energization percentage.

7. An image forming apparatus comprising:

an image forming unit configured to form a toner image on a sheet;

a fusing unit configured to fuse the toner image formed on the sheet, where the fusing unit includes a heating unit heated upon receiving power supplied from an alternating-current power supply;

a temperature detecting unit configured to detect a temperature of the heating unit;

a memory storing data of a power energization pattern in which power energization and non-power energization are performed for each power energization percentage of alternating current power supplied to the heating unit; and a power control unit configured to determine a power energization percentage of alternating current power applied from the alternating-current power supply to the heating unit based on the detected temperature and read out a power energization pattern for the heating unit from the memory according to the determined power energization percentage, wherein, when a first power energization percentage is changed to a second power energization percentage, the power control unit determines a power energization pattern at the second power energization percentage based on a power energization pattern at the first power energization percentage and the power energization pattern read out from the memory according to the second power energization percentage.

* * * * *